US005918769A

United States Patent [19]

Capriglione

[11] Patent Number: 5,918,769

[45] Date of Patent: Jul. 6, 1999

[54] CEREAL SELECTOR AND DISPENSER

[76] Inventor: Carmine Joseph Capriglione, 409 Linton Ct., Dumfries, Va. 22026

[21] Appl. No.: 08/980,551

[22] Filed: Dec. 1, 1997

[51] Int. Cl.[6] ..... B67D 5/60

[52] U.S. Cl. ..... 222/132; 222/185.1; 222/517

[58] Field of Search ..... 222/132, 144, 222/144.5, 517, 185.1; 141/360, 362

[56] References Cited

U.S. PATENT DOCUMENTS

| | | | |
|---|---|---|---|
| 618,219 | 1/1899 | Bell | 222/144 |
| 1,033,689 | 7/1912 | Fuchs | 222/512 X |
| 1,424,682 | 8/1922 | Schlosser | 222/144 |
| 1,438,173 | 12/1922 | Feindt | 222/144.5 X |
| 4,558,804 | 12/1985 | Keck | 222/144 X |
| 5,088,626 | 2/1992 | Patton et al. | 222/132 |

*Primary Examiner*—Gregory L. Huson
*Attorney, Agent, or Firm*—Harold H. Dutton, Jr.

[57] ABSTRACT

A cereal selector and dispenser comprising a cylindrical receptacle having a cover, a divider for separating the receptacle into three substantially equally sized compartments for containing cereals to be dispensed, and a mounting base for elevating the receptacle above a support surface, each of the compartments having a dispensing opening and a chute located at the bottom of each compartment, and spring biased, hinged flaps for obturating each respective dispensing opening, whereby a receiving bowl may be placed under one of the chutes and a desired quantity of a selected product may be dispensed into the receiving bowl by actuation of the one of the flaps positioned above the receiving bowl.

4 Claims, 1 Drawing Sheet

CEREAL SELECTOR AND DISPENSER

This invention relates to a cereal selector and dispenser. More particularly, the invention relates to a unique cereal selector and dispenser which includes a tri-geometric design for storing three different breakfast cereals in the device. The different cereals may then be easily selectively dispensed as desired for use. The device is particularly adapted for use in the home.

FIELD OF THE INVENTION

The present invention relates to storage devices used in the home for storing food products, particularly for the storage of bulky products such as breakfast cereals, while keeping the cereals in a fresh and palatable condition until they are used. The storage device permits one of three stored cereals to be easily dispensed from storage without waste, and easily avoiding spillage.

DESCRIPTION OF THE INVENTION

The present invention comprises a cylindrical receptacle housing, preferably made of clear plastic in order that the use may see the contents thereof through the wall of the housing. The receptacle housing is open at the top but is provided with a tight fitting lid to keep stored product fresh. A removable divider is inserted into the receptacle for dividing the same into three compartments of essentially equal size. At the bottom of each compartment of the housing, a plurality of dispensing flaps are provided, one for each compartment. The bottom of the housing is also formed in the shape of a chute, and the flaps are spring biased toward the chute, for obturating the chute. A lever attached to each flap serves as a manipulating handle for actuating the flap to dispense product when desired. The spring holds the flap closed against the open end of the chute.

The receptacle housing is supported by a base in the nature of a tripod, with three legs spaced equidistant around the central longitudinal axis of the housing, and positioned in such a manner that each chute is generally centrally positioned between two of the legs. The legs are designed to support the receptacle housing slightly elevated with respect to a support surface, so that a cereal bowl may be placed beneath the desired chute to receive the product from the selected compartment.

The foregoing objects and advantages of the present invention will become more apparent from a consideration of the following detailed description of a preferred embodiment, with reference to the accompanying drawings showing the invention by way of a non-limiting example thereof, in which.

DETAILED DESCRIPTION OF PREFERRED EMBODIMENT

Figure 1:
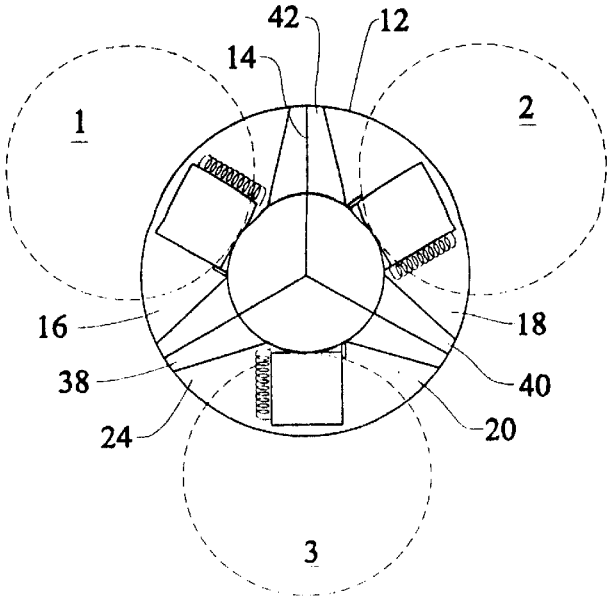
FIG. 1 is a top plan view if the selector dispenser of the present invention with the cover removed.
Figure 4:
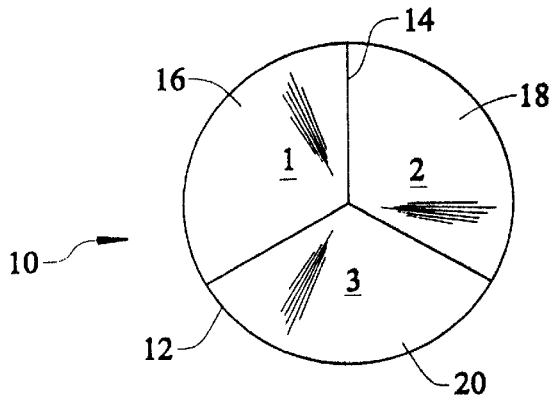
FIG. 4 is a schematic view of the receptacle housing showing the divider installed therein.

Referring to the accompanying drawings, the present invention is seen to comprise a receptacle housing generally designated 10 which comprises a generally cylindrical housing wall 12 preferably made of a transparent plastic, in order that the consumer can see the contents. A divider 14 is inserted into the housing 12 and thereby divides the housing 12 into three compartments 16, 18 and 20. A tight fitting lid 22 is provided for closing the top of the housing 12. At the bottom of each of the compartments 16, 18 and 20 is provided a bottom wall 24 in the shape of a chute, and each chute is provided with an obturating flap 26 pivotally attached to the wall 12 at 28, and biased toward the chute wall 24 for closing the chute. A spring 30 is provided for urging the flap 26 toward the chute. A lever 32 is attached to each flap 26, and serves as a handle for manipulatively pivoting the flap 26 in the direction of the arrow and thereby opening the respective compartment for allowing the discharge of the contents by gravity. One flap is provided for each compartment 16, 18 and 20.

The divider 14 is removable from the housing 12 to facilitate cleaning of the device and the divider.

Figure 2:
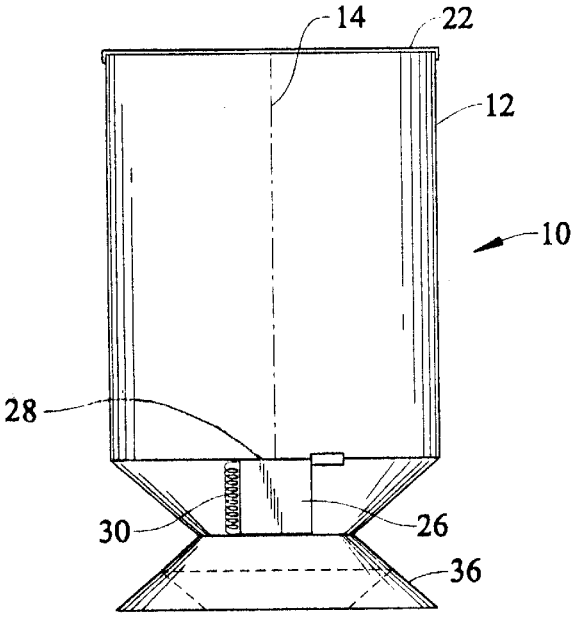
FIG. 2 is an elevational view of the selector dispenser.
Figure 3:
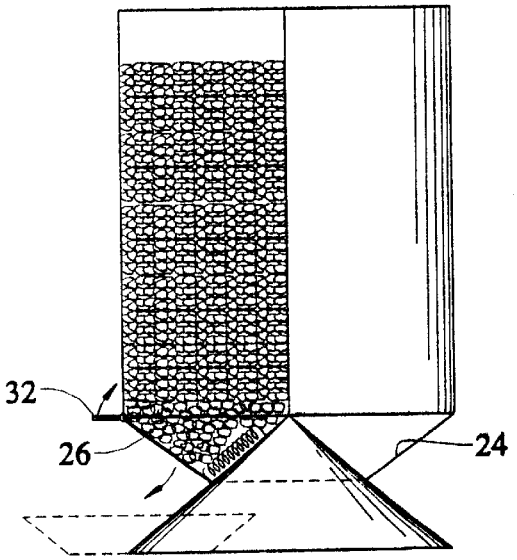
FIG. 3 is a longitudinal cross-sectional view of the selector dispenser.

A tripod pedestal base 36 is provided and includes three spaced legs 38, 40 and 42. This base serves to elevate the housing 12 above a support surface, in order that a cereal bowl may be positioned beneath the desired chute, for receiving product in one of the compartments 16, 18 or 20. Thus, a bowl may be positioned as shown in dotted line positions 1, 2 or 3 in FIG. 1, and will also be positioned beneath the chute 24 as seen in FIGS. 2 and 3. In this manner, when the lever 32 is pivoted in the direction shown in the arrow, the flap 26 is opened and cereal product is dispensed through the chute. When the lever 32 is released, the flap 26 closes, stopping the flow of cereal.

As seen, the chutes 24 are positioned between the legs 38, 40 and 42, which allows a cereal bowl to fit beneath any one of the chutes. Thus, the device can fit on a counter top in a kitchen, beneath cabinets, and hold about two quarts of cereal in each of the three compartments. Moreover, when it is necessary to clean the device, the lid and divider may be easily removed, thereby allowing full access to the interior of the device.

While this invention has been described as having certain preferred features and embodiments, it will be apparent that it is capable of still further variation and modification without departing from the spirit of the invention, and this application is intended to cover any and all variations, modifications and adaptations as may fall within the spirit of the invention and the scope of the appended claims.

I claim:

1. A cereal selector and dispenser comprising a cylindrical receptacle having a cover, a divider for separating said receptacle into three substantially equally sized compartments for containing cereals to be dispensed, and a mounting base for elevating the receptacle above a support surface, each of said compartments having a dispensing opening and a chute located at the bottom of each compartment and spring biased, hinged flaps for obturating each respective dispensing opening, whereby a receiving bowl may be placed under one of said chutes and a desired quantity of a selected product may be dispensed into the receiving bowl by actuation of the one of said flaps positioned above the receiving bowl.

2. A cereal selector and dispenser as in claim 1 and wherein said receptacle is formed of a transparent material.

3. A cereal selector and dispenser as in claim 2 and wherein said mounting base comprises a tripod so positioned that a bowl positioned beneath one of said chutes rests between two of the legs of said tripod.

4. A cereal selector and dispenser as in claim 3 and wherein said divider is removable from said receptacle.

* * * * *